US011452325B2

(12) United States Patent
Feinroth

(10) Patent No.: US 11,452,325 B2
(45) Date of Patent: Sep. 27, 2022

(54) PATTERN MAKING SYSTEM

(71) Applicant: Tzirel Leah Feinroth, Lakewood, NJ (US)

(72) Inventor: Tzirel Leah Feinroth, Lakewood, NJ (US)

( * ) Notice: Subject to any disclaimer, the term of this patent is extended or adjusted under 35 U.S.C. 154(b) by 159 days.

(21) Appl. No.: 16/728,234

(22) Filed: Dec. 27, 2019

(65) Prior Publication Data

US 2021/0195977 A1 Jul. 1, 2021

(51) Int. Cl.
*A41H 3/015* (2006.01)
*A41H 3/00* (2006.01)

(52) U.S. Cl.
CPC ..... *A41H 3/00* (2013.01); *A41H 3/015* (2013.01)

(58) Field of Classification Search
None
See application file for complete search history.

(56) References Cited

U.S. PATENT DOCUMENTS 556,856 A * 3/1896 Livingston ..... A41H 3/015 33/14
4,156,969 A * 6/1979 Werber ..... A41H 3/015 33/14

* cited by examiner

*Primary Examiner* — Alexander S Thomas
(74) *Attorney, Agent, or Firm* — Ezra Sutton; Anthony Morano

(57) ABSTRACT

A pattern making system having upper and lower sloper sections that are connected together at different heights to adjust the overall height of the upper and lower sloper sections. The upper and lower sloper sections have multiple widths and lengths, so that an upper section of a first width and length can be connected to a lower section of a second and different width and length, so that the sloper has different widths and lengths, which can be accommodated. In order to connect the upper and lower sloper sections, two T-shaped elongated sliding connector rods are provided for sliding within respective guide paths on the lower sloper section. In addition, the connector rods also have lower sections for sliding within the guide paths on the lower sloper section. In this manner, the sliding connector rods are moved in the guide paths relative to the upper sloper section and lower sloper section to vary the distance between the upper and lower sloper sections in order to vary the height of the sloper.

8 Claims, 13 Drawing Sheets

PATTERN MAKING SYSTEM

FIELD OF THE INVENTION

The invention relates to a pattern making system and method having adjustable height upper and lower sloper sections to change the height of the sloper, and interchangeable upper and lower sloper sections to adjust the width of the sloper, and adjustable length sleeve sections to change the length of the sleeve of the sloper.

BACKGROUND OF THE INVENTION

When a person wants to create a garment, a pattern needs to be drafted first. This is done by either draping on a mannequin or flat patternmaking using measurements and lines drawn on paper. Draping is beyond the skill level of a home sewer and many do not have a mannequin to use.

Flat patternmaking is the choice method for the home sewer. First a well-fitting sloper, like a basic shell, is needed. After tracing the sloper, the person will proceed with design lines and manipulations on the traced sloper. An endless amount of designs can be constructed using a sloper.

There are many who want to create their own patterns with their original designs, but cannot do so. This is because creating the sloper requires a large amount of skill and expertise. A home sewer does not have this background.

Oftentimes a sewer is looking to create a pattern for a commonly used design. But due to their specific body measurements, they do not fit one size sloper for the upper and lower. Without a sloper that can fit their complex size, they do not have the means to make even a basic design.

When a sloper is not well balanced with a perfect fit, every design made using that sloper will not fit correctly. This system provides the user with a well-balanced sloper that can be adjusted for both height and width. The user can now use this sloper to create endless personal designs for garments.

Thus, there is a present need to provide a pattern making system that provides ready-made slopers used in pattern making to be easily adjustable in height and width, and also provides ready-made slopers for sleeves to be adjustable in length. In this manner, the slopers can accommodate persons having different heights and widths, including persons who are wider on the bottom, or taller in height, or persons having different length sleeves.

DESCRIPTION OF THE PRIOR ART

Although there are a number of prior art patents on pattern making, they do not teach the present invention of disclosing a method of providing ready-made upper and lower sloper sections, which are adjustable in height using adjustable parallel sliding rods. The invention also teaches providing ready-made interchangeable upper and lower sloper sections of different widths in order to adjust the width of the sloper sections. Also, the prior art patents do not teach providing ready-made slopers for sleeves using adjustable parallel sliding rods.

For example, U.S. Pat. No. 8,813,378, granted in 2014, discloses drafting garment patterns from body photographs and garment style drawings for creating adjustable pattern style drawings and for drafting garment patterns from the pattern style drawings.

Also, U.S. Pat. No. 9,456,647, granted in 2016, discloses designing garments from software templates and drafting garment patterns from body photograph.

In addition, Canadian Patent No. 2,492,358A1, discloses a garment pattern template (100) to be worn by a person including a plurality of detachably coupled sections, each having a plurality of flexible segments (110) which are coupled at pivot points. The adjustable segments include at least two strips which are longitudinally slidable such that the segments are adjustable in length and can be fixed in length. However, the problem is that the user can angle the adjustable segments incorrectly, and thereby the pattern will not fit well. In addition, the user also needs to try and accurately align the segments, which is a time consuming process and requires skill to do so. Further, it is necessary for the user to place the garment pattern template around the body of the user, and it cannot be used in a flat configuration.

OBJECTS OF THE INVENTION

It is an object of the present invention to provide ready-made upper and lower sloper sections, which are adjustable in height;

Another object of the present invention is to provide ready-made upper and lower sloper sections that have different widths, which are interchangeable to use a wider sloper bottom section with a narrower sloper top section, or vice versa;

Another object of the present invention is to provide connectors for upper and lower sloper sections to easily adjust the height of the sloper;

Another object of the present invention is to provide connectors for upper and lower sloper sections having measurements on them, so the sloper sections can be adjusted to the desired height;

Another object of the present invention is to provide front upper slopers and rear upper slopers, wherein each sloper is adjustable in height using adjustable connectors;

Another object of the present invention is to provide a sloper for a sleeve to adjust the length of the sleeves.

SUMMARY OF THE INVENTION

A pattern making system having upper and lower sloper sections that are connected together at different heights to adjust the overall height of the upper and lower sloper sections.

In order to connect the upper and lower sloper sections, two adjustable T-shaped elongated sliding connector rods are provided for sliding within respective guide paths on the upper sloper section. In addition, the connector rods also have lower sections for sliding within the guide paths on the lower sloper section. In this manner, the sliding connector rods are moved in the guide paths relative to the upper sloper section and lower sloper section to vary the distance between the upper and lower sloper sections in order to vary the height of the sloper.

The ready-made upper and lower sloper sections may have different widths, so that an upper section of a first width can be connected to a lower section of a second and different width. In this manner, the slopers have different widths, which can accommodate persons of different widths in the upper and lower sections.

In addition, the sliding connector rods on different upper and lower widths are interchangeable, so the sliding rods on one width can match up with the sliding rods on different widths, in order to balance the upper and lower sloper sections.

DETAILED DESCRIPTION OF THE PREFERRED EMBODIMENT

A pattern making system to make adjustable height slopers 10 and slopers of different widths.

Figure 1:
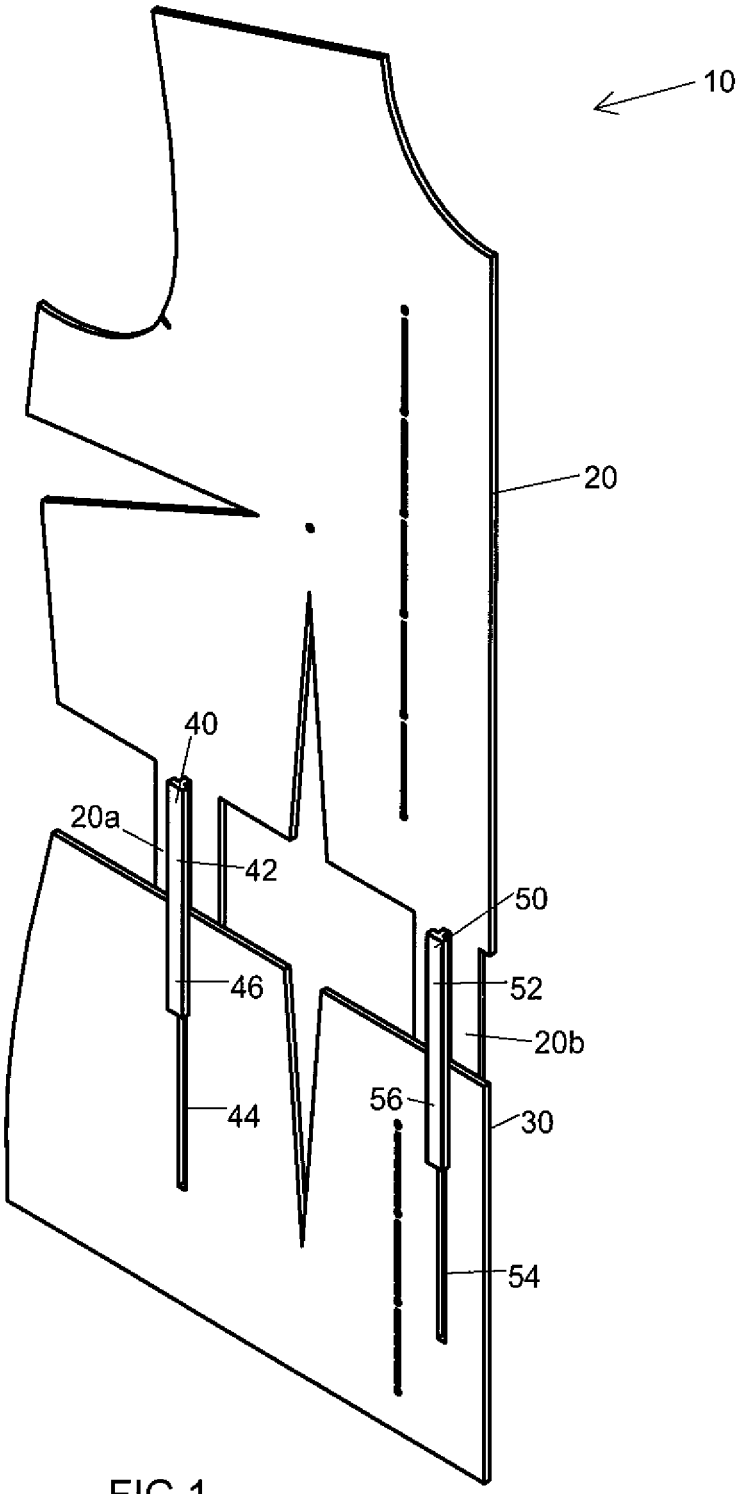
FIG. 1 is a perspective view of upper and lower sloper sections connected together by a sliding connector to adjust the height of the sloper, wherein the sliding connector rod is mounted on the upper sloper section, and wherein the sliding guide is located in the lower sloper section.

FIG. 1 shows a perspective view of the upper sloper section 20 and the lower sloper section 30, which are connected together by two T-shaped elongated sliding connector rods 40 and 50, which are mounted on the upper sloper section 20, and wherein the lower sliding guides 44 and 54 are located on the lower sloper section 30. The two sliding connector rods 40 and 50 each have an upper section 42 and 52 for sliding within respective guide paths 44 and 54. In addition, connector rods 40 and 50 each also have lower sections 46 and 56 for sliding within respective guide paths 44 and 54. In this manner, the sliding connector rods 40 and 50 are moved in the guide paths relative to the upper sloper section 20 and lower sloper section 30 to vary the distance between the upper sloper section 20 and lower sloper section 30 to vary the height of the sloper 10.

Figure 2:
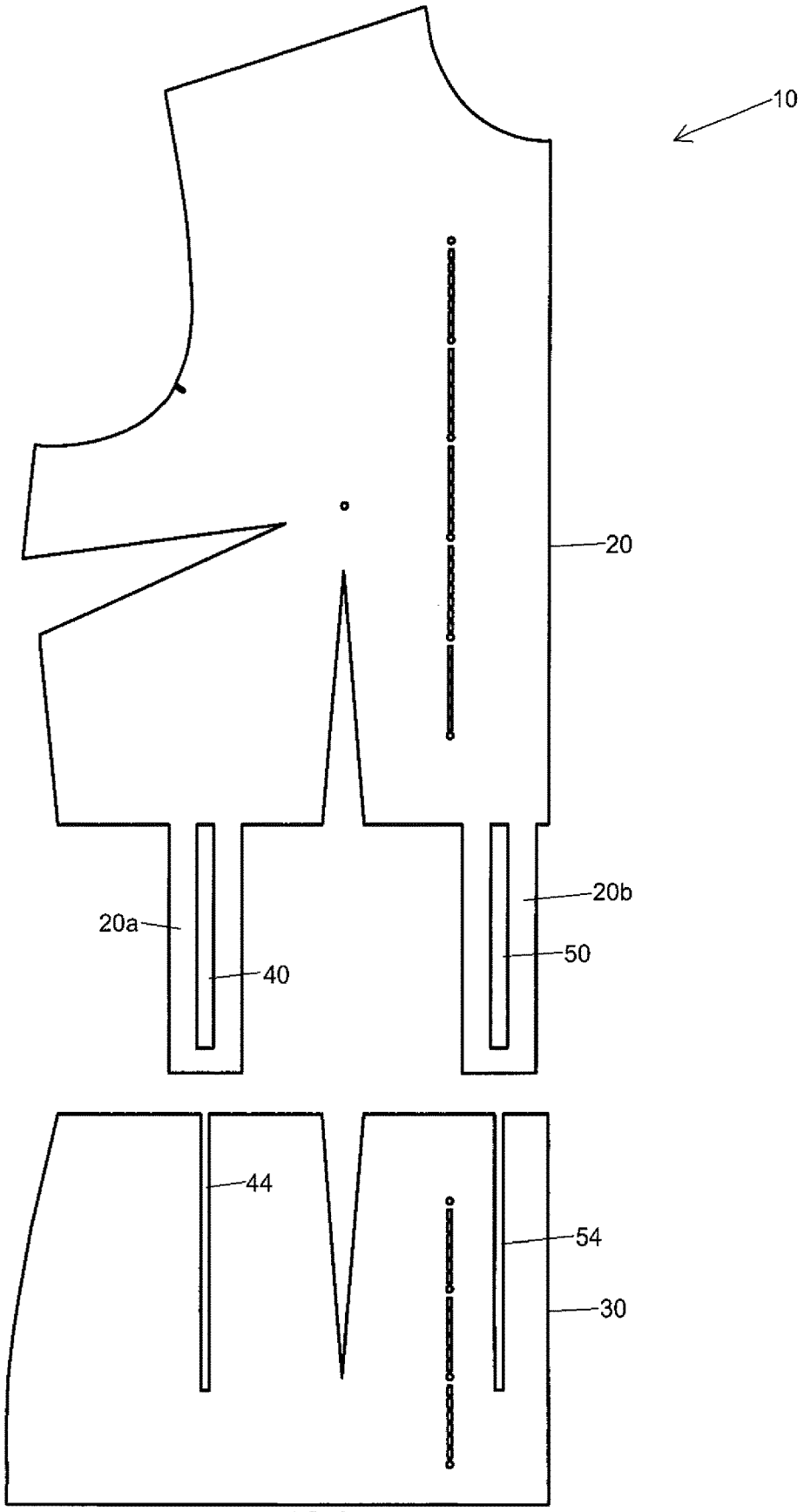
FIG. 2 is a front view of the upper and lower sloper sections shown separated to provide for different heights for different persons, wherein the sliding connector rods are mounted on the upper sloper section, and wherein the sliding guides are located in the lower sloper section.

FIG. 2 shows a front view of the upper and lower sloper sections 20 and 30, shown separated to provide different heights for all persons, wherein connector rods 40 and 50 are moved in parallel for sliding within respective guide paths 44 and 54.

Figure 3:
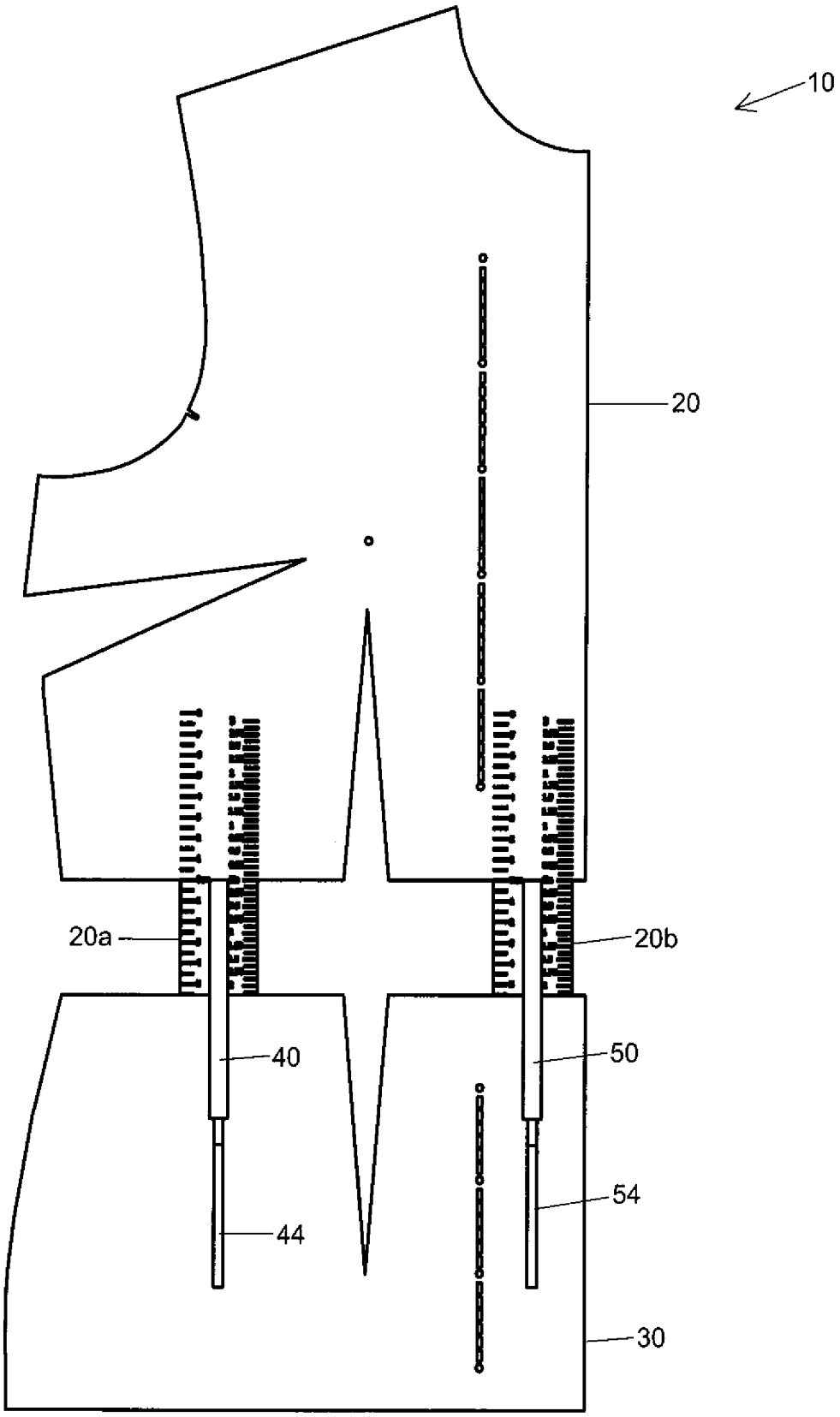
FIG. 3 is a front view of the upper and lower sloper sections shown connected together to provide a first adjustable height, with the measurements shown on the measurement device connected to the sliding connector rod for accommodating a taller person.

FIG. 3 is a front view of the upper and lower sloper sections 20 and 30 shown connected together to provide a first adjustable height for a taller person, with the measurements shown on the measurement devices 20*a* and 20*b* connected to the sliding connector rods 40 and 50. The measurements are provided to accommodate both taller and shorter persons.

Figure 4:
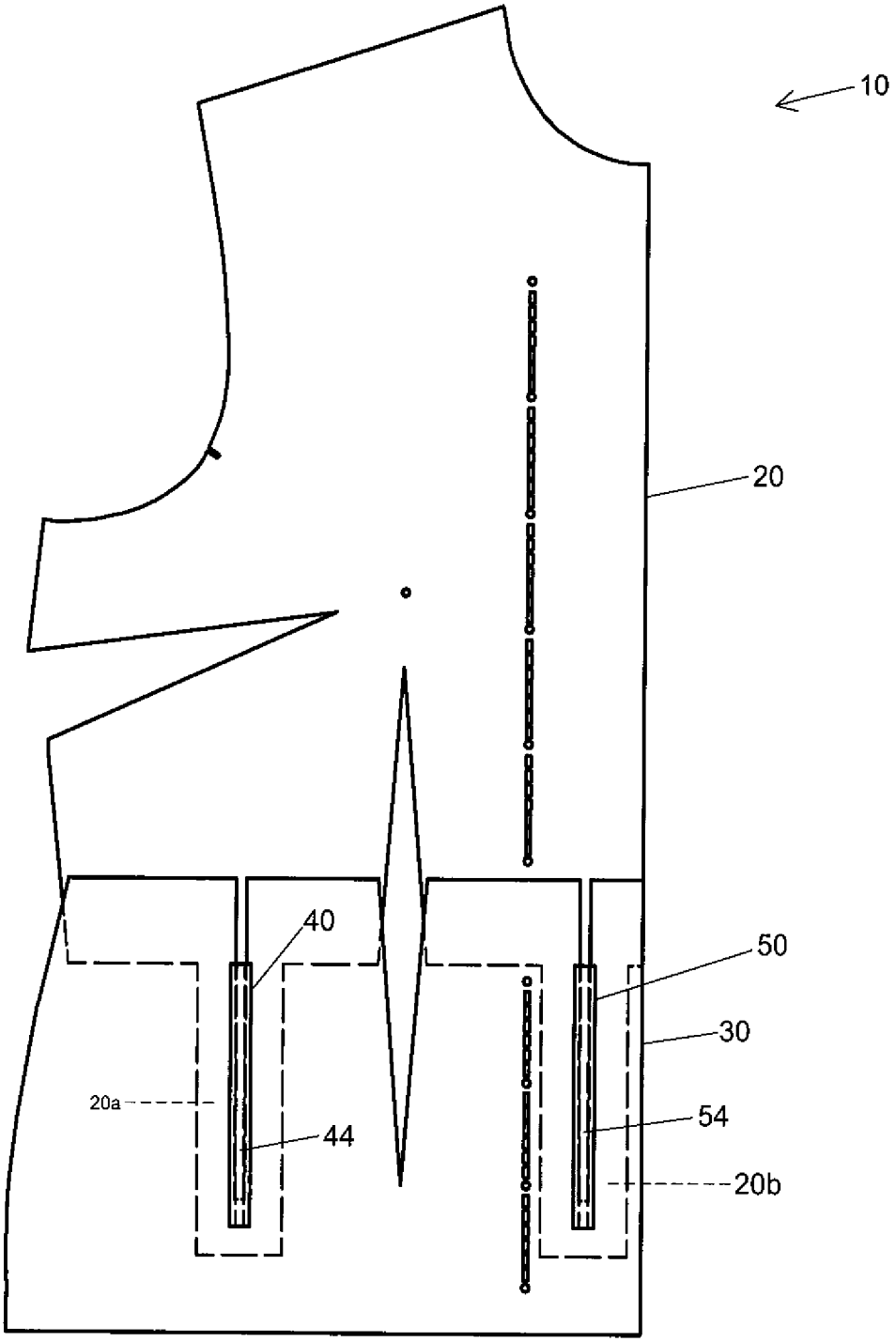
FIG. 4 is a front view of the upper and lower sloper sections shown connected together with the lower section overlapping the upper section to provide a second adjustable height for accommodating a shorter person.

FIG. 4 is a front view of the upper and lower sloper sections 20 and 30 shown connected together with the first lower section 30 overlapping the upper section 20 to provide a second adjustable height for a shorter person.

Figure 5:
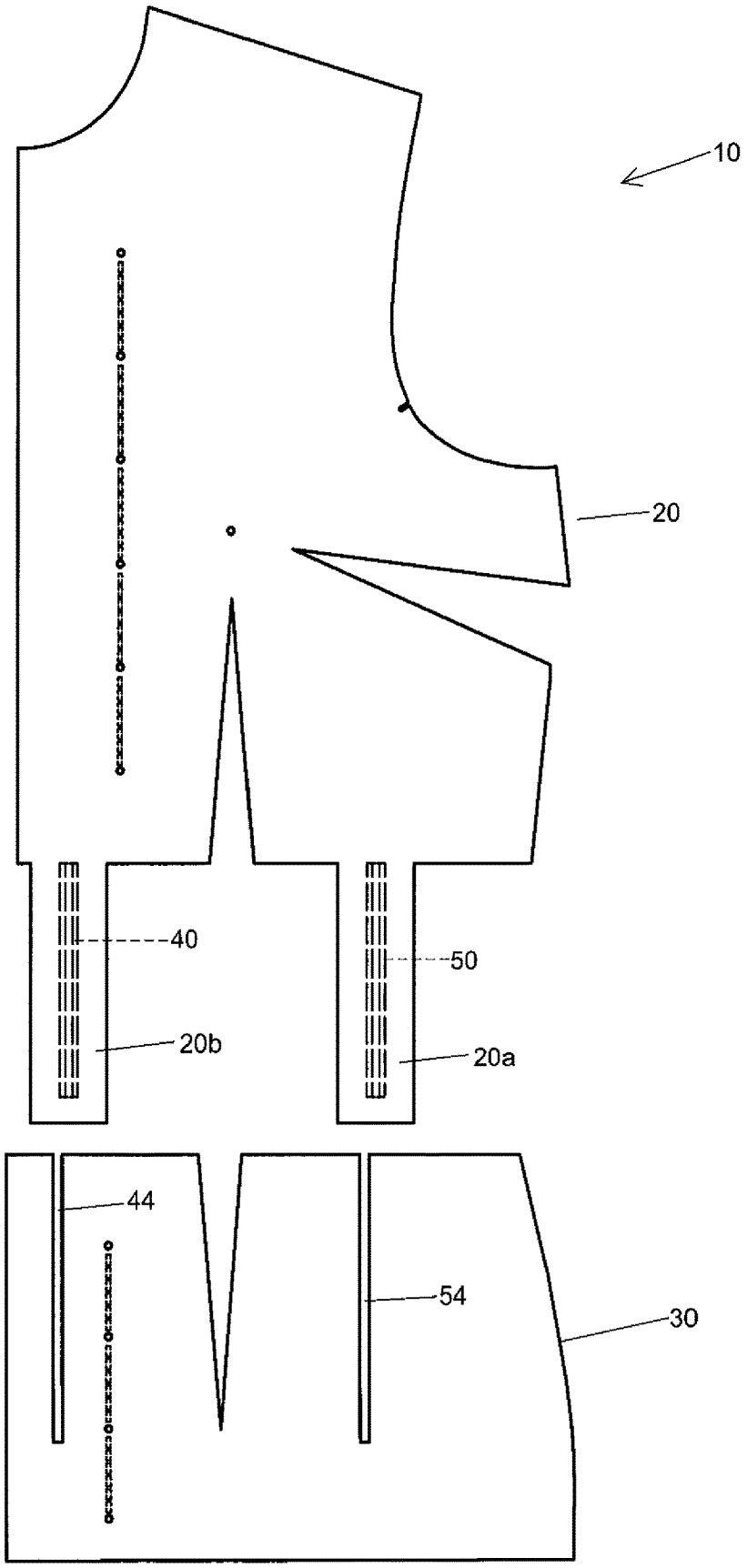
FIG. 5 is a back view of FIG. 2 showing the rear side of the upper and lower sloper sections shown separated and having parallel sliding rods.

FIG. 5 is a back view of FIG. 2 showing the rear side of the upper and lower sloper sections 20 and 30 shown separated and having parallel sliding rods 40 and 50 mounted on devices 20*a* and 20*b*.

Figure 6:
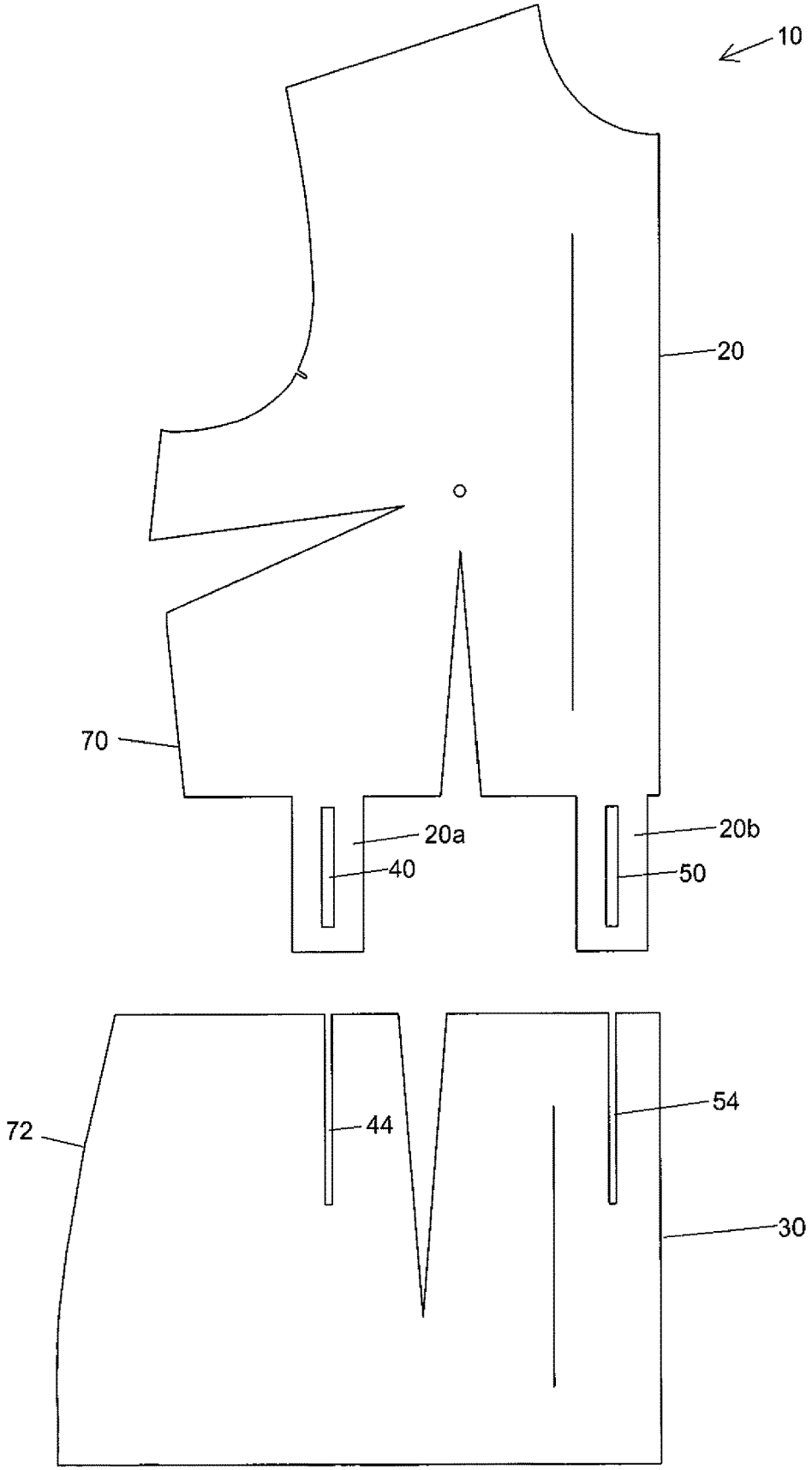
FIG. 6 is a front view of the upper and lower sloper sections shown separated and having parallel sliding rods, wherein the lower section has a wider bottom width, as compared to the upper sloper section to accommodate persons having different specific widths.
Figure 7:
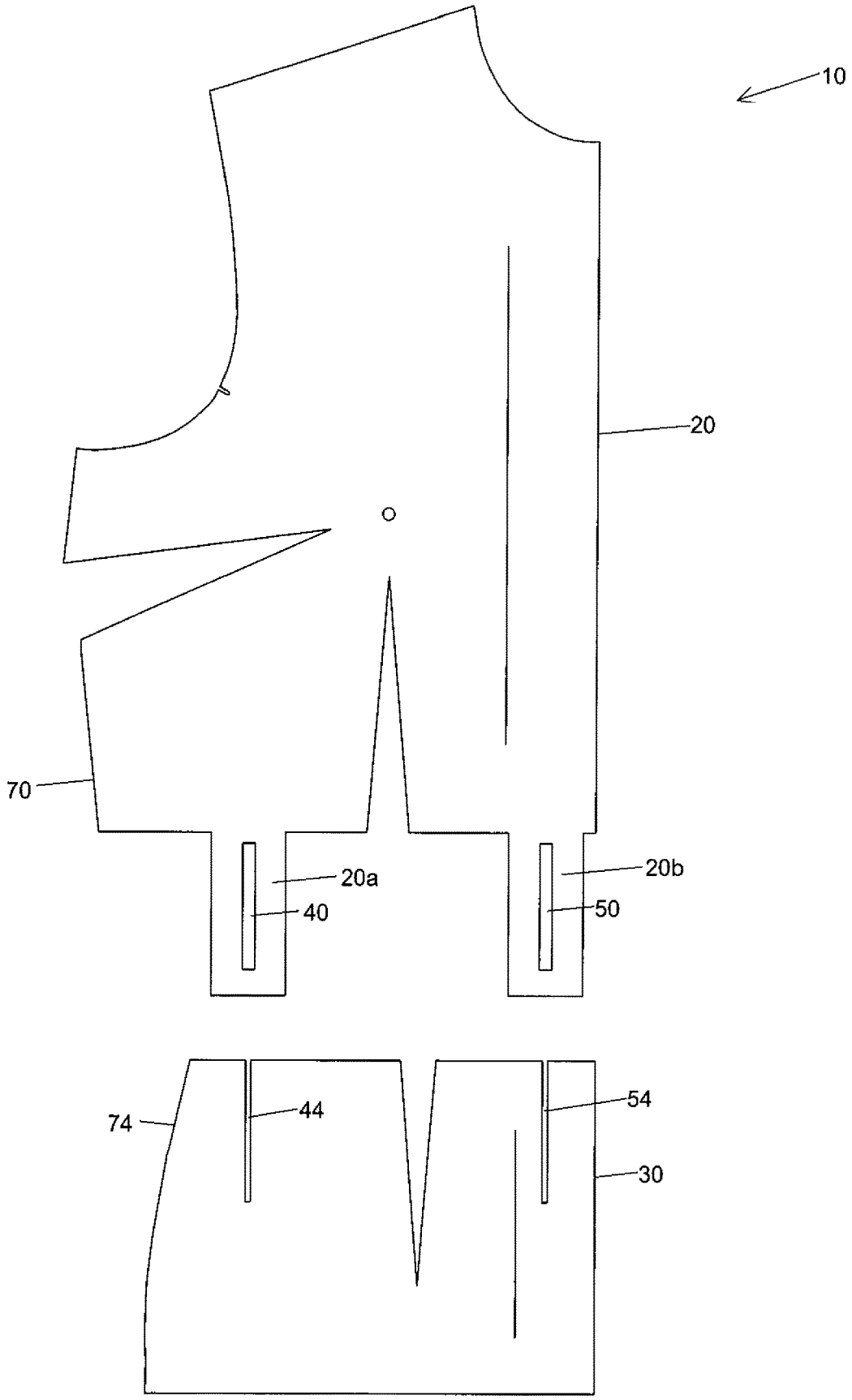
FIG. 7 is a front view of the upper and lower sloper sections shown separated and having parallel sliding rods, wherein the lower section has a narrower bottom width, as compared to the upper sloper section to accommodate persons having different specific widths.

FIG. 6 is a front view of the upper and lower sloper sections 20 and 30 shown separated and having sliding rods 40 and 50, wherein the lower section 30 has a wider bottom width 72, as compared to the width of the upper sloper section 20. FIG. 7 is a front view of the upper and lower sloper sections 20 and 30 shown separated and having sliding rods 40 and 50, wherein the lower section 30 has a narrower bottom width 74, as compared to the upper sloper section 20.

Therefore, as shown in FIG. 6, upper section 20 of sloper 10 has a first width 70 and the lower section 30 has a different and second wider bottom width 72. FIG. 7 has a lower section 30 of sloper 10 having a second and narrower width 74. Accordingly, upper section 20 of a sloper 10 has a first width 70 that can be connected to a lower section 30 of a sloper 10 having a second width 74. In this manner, sloper 10 has an upper section 20, which is of a different width than lower section 30, in order to accommodate a person having a wider top and a narrower bottom. In addition, the reverse can be done, wherein a person having a narrower top and a wider bottom can be accommodated.

Figure 8B:
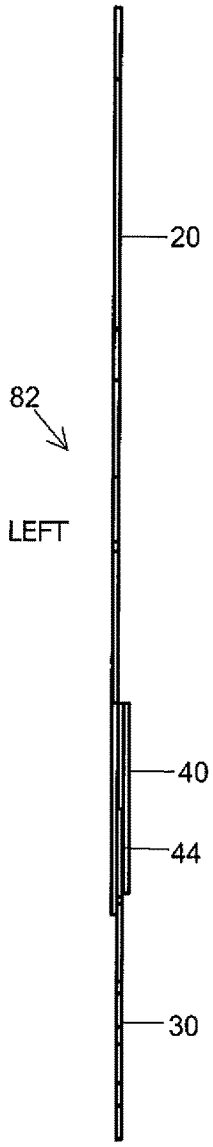
FIG. 8*b* is a vertical edge view showing the left edge of FIG. 3.
Figure 8C:
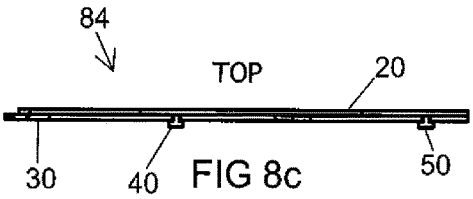
FIG. 8*c* is a top edge view showing the top edge of FIG. 3.
Figure 8D:
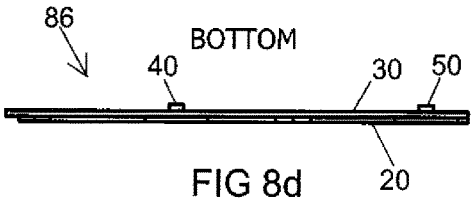
FIG. 8*d* is a bottom edge view showing the bottom edge of FIG. 3.
Figure 8A:
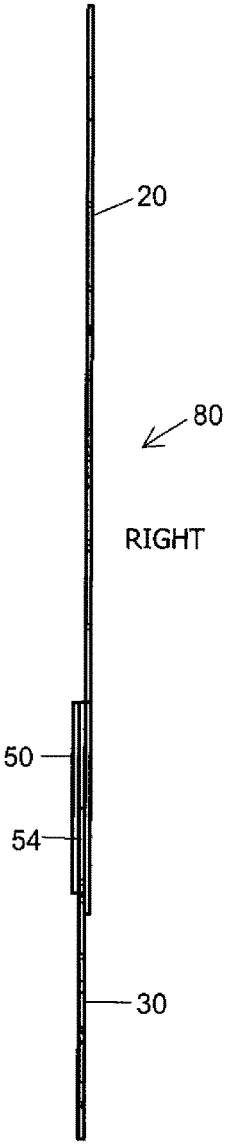
FIG. 8*a* is a vertical edge view showing the right edge of FIG. 3.

FIG. 8*a* is a vertical edge view showing the right edge 80 of FIG. 3, and FIG. 8*b* is a vertical edge view showing the left edge 82 of FIG. 3. FIG. 8*c* is a top edge view 84 showing the top edge of FIG. 3, and FIG. 8*d* is a bottom edge view 86 showing the bottom edge of FIG. 3.

Figure 12:
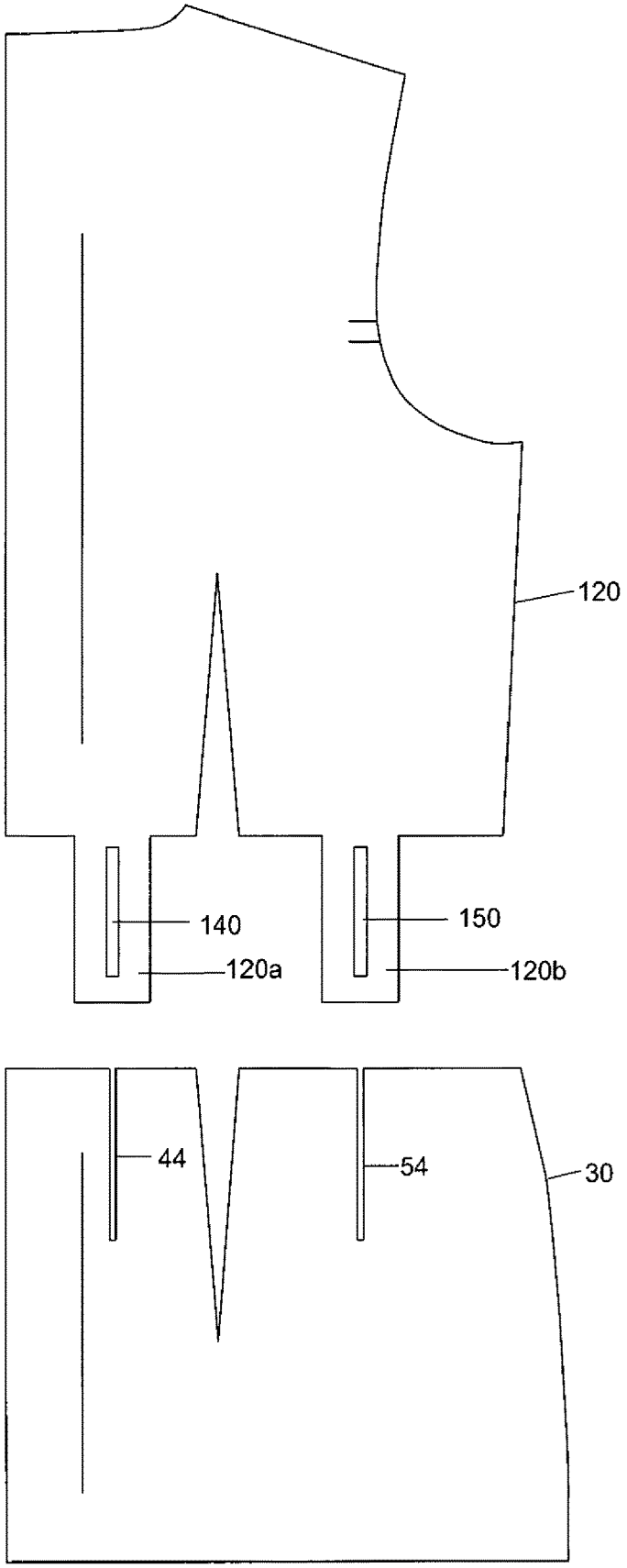
FIG. 12 is a front view of the upper and lower sloper sections showing a back sloper to make a pattern, wherein the upper and lower sloper sections are separated to provide different heights, and wherein the sliding connector rods are mounted on the upper sloper section.

FIG. 12 is a front view of the upper sloper section 120 for the back sloper, wherein the upper sloper back section 120 and lower sloper section 30 are separated to provide different heights for a taller person, and wherein the sliding connector rods 140 and 150 are mounted on the upper sloper section 120, which have extensions 120*a* and 120*b*.

Second Embodiment

Figure 9:
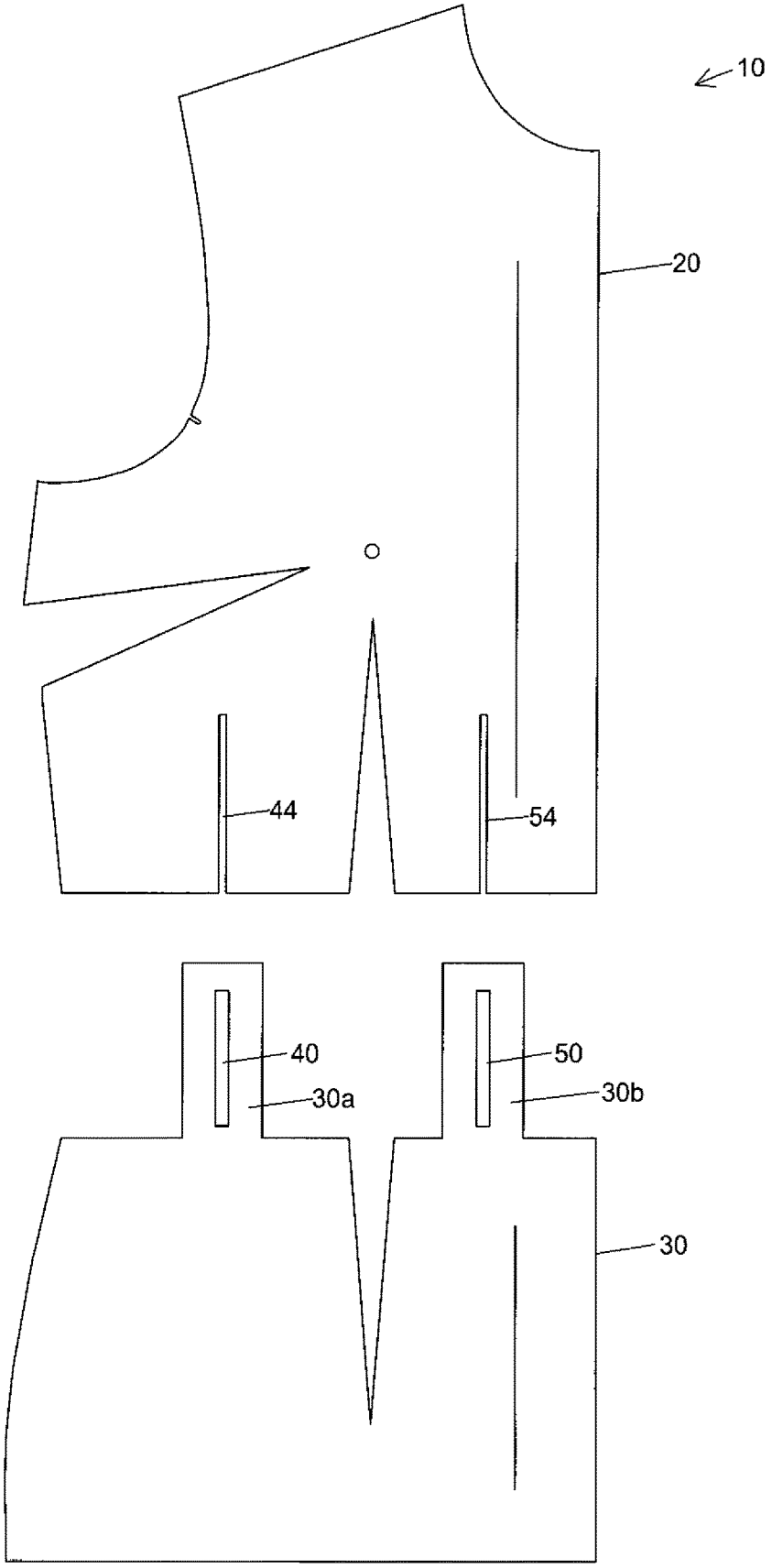
FIG. 9 is a front view of the upper and lower sloper sections shown separated to provide different heights for different persons showing an alternate embodiment, wherein the sliding connector rods are mounted on the lower sloper section.

FIG. 9 shows a second embodiment of the present invention, wherein the front view of the upper and lower sloper sections 20 and 30 are shown separated to provide different heights for all persons. However, in this alternate embodiment, the sliding connector rods 40 and 50 are mounted on the lower sloper section 30, instead of upper sloper section 20.

Third Embodiment

Figure 10:
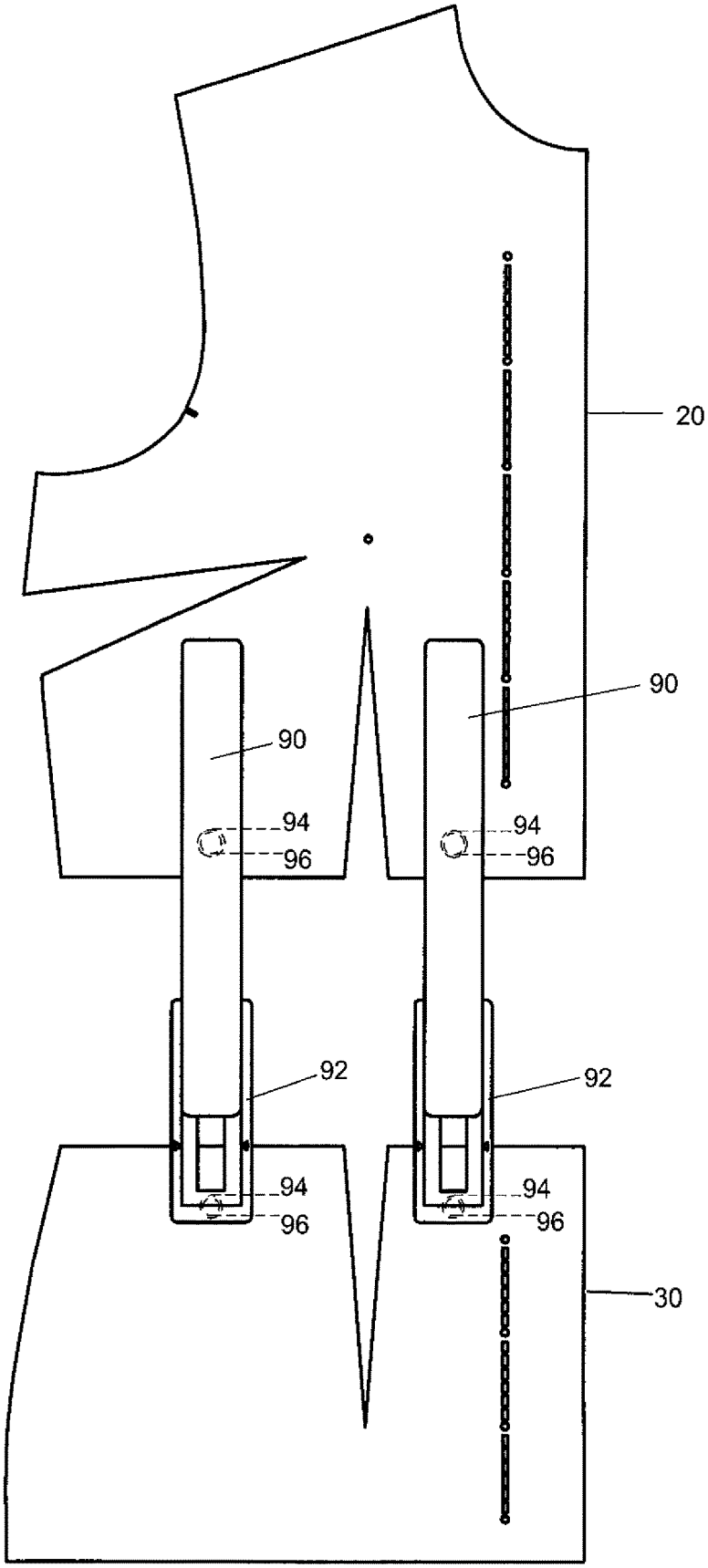
FIG. 10 is a front view of the upper and lower sloper sections shown separated to provide different heights for different persons showing an alternate embodiment, wherein the connector holes are mounted on the upper and lower sloper sections.
Figure 10A:
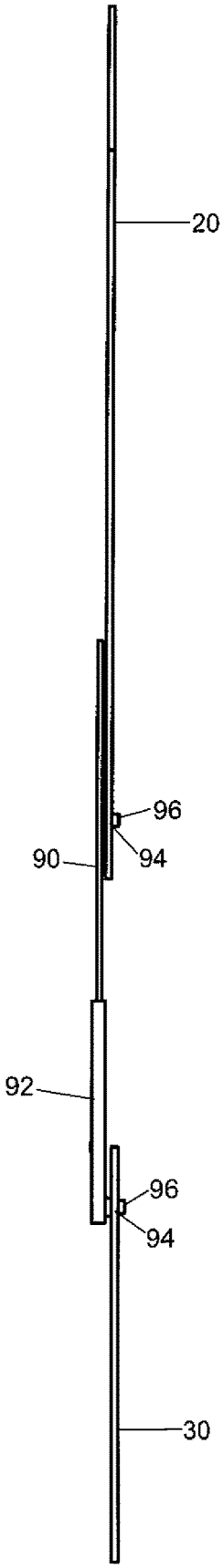
FIG. 10*a* is a vertical edge view showing the right edge of FIG. 10.

FIGS. 10, 10*a*, and 11 show a third embodiment of the present invention, wherein the upper and lower sloper sections 20 and 30 may be connected by two or more connector rods 90 having extension members 92 for adjusting their height. The pegs 96 are mounted on the members 90 and 92. The receiving holes 94 for receiving pegs 96 are formed in the upper and lower sloper sections 20 and 30 to adjust the height of the connected upper and lower sloper sections 20 and 30 using this alternate construction.

Figure 11D:
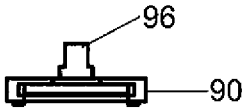
FIG. 11*d* is a top edge view of the connector element having connector pegs.
Figure 11B:
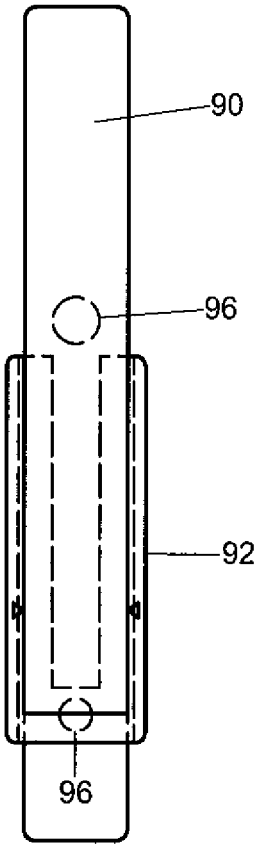
FIG. 11*b* is a front view of the connector element having connector pegs.
Figure 11C:
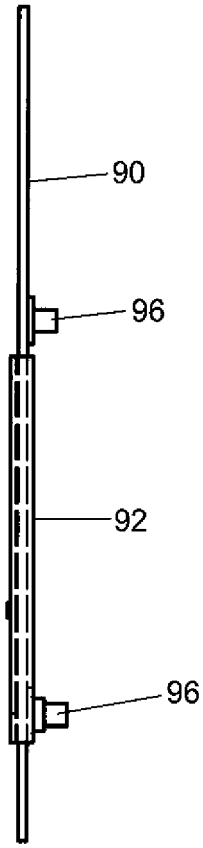
FIG. 11*c* is a side edge view of the connector element having connector pegs.
Figure 11A:
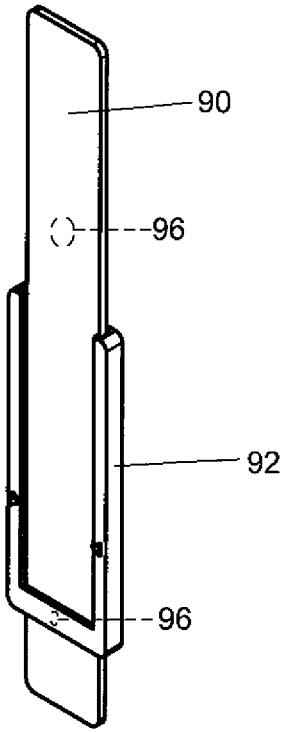
FIG. 11*a* is a perspective view of the connector element having connector pegs.
Figure 11E:
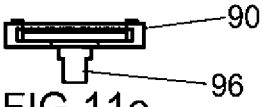
FIG. 11*e* is a bottom edge view of the connector element having connector pegs.

FIG. 11*a* is a detailed perspective view showing the connector rods 90 and extension members 92. FIG. 11*b* is a front view of the connector pegs 96 which are received in receiving holes 94 (shown in FIGS. 10 and 10*a*), and the connector rods 90 and extension members 92, having connector pegs 96. FIG. 11*c* is a side edge view of the same elements 90, 92, and 96. FIG. 11*d* is a top edge view of the connector rod 90 having connector pegs 96, and FIG. 11*e* is a bottom edge view of connector rod 90 and connector pegs 96.

Fourth Embodiment

Figure 13:
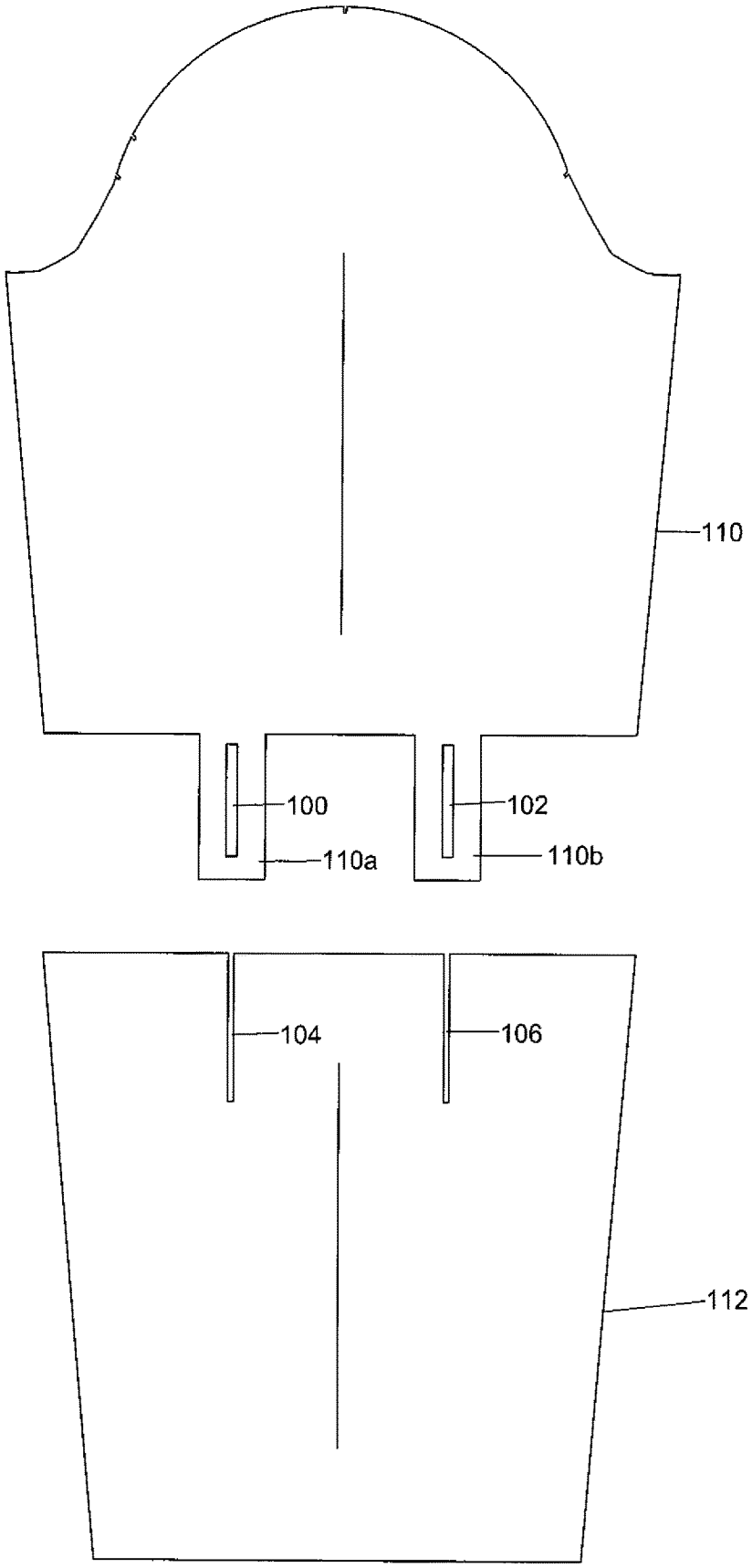
FIG. 13 is a front view of the upper and lower sloper sleeve sections to make a sleeve patterns, which are separated to provide for different length sleeves, and wherein the sliding connector rods are mounted on the upper sleeve section or the lower sleeve section.

FIG. 13 is a front view of the upper sleeve sloper section 110 and lower sleeve sloper section 112 for forming a sleeve, wherein the upper and lower sleeve sloper sections 110 and 112 are separated to provide adjustable length sleeve sloper sections to accommodate different sleeve lengths. Also, in this embodiment, the sliding connector rods 100 and 102 are mounted on the extensions 110*a* and 110*b* of upper sleeve sloper section 110. The corresponding sliding guides 104 and 106 are mounted on the lower sleeve sloper section 112. The sleeve sloper is provided in all widths which will provide all sizes necessary.

Operation

In operation, the sliding connector rods 40 and 50 are moved in the guide paths relative to the upper sloper section 20 and lower sloper section 30 to vary the distance between the upper sloper section 20 and lower sloper section 30 to vary the height of the sloper 10, in order to accommodate persons of different heights.

In operation, the upper sloper section 20 can be made in all sizes, including such sizes as 0 to 22, and comparable European sizes. Also, the lower sloper section 30 can be made in all sizes, including such sizes as 0 to 22, and comparable European sizes. In this manner, the user can select an upper section of any size, such as a size 4, to be matched with a lower section of any size, such as a size 8, so that the upper sloper section and lower sloper section 30 accommodates all persons in different size ranges and different widths.

In operation, the upper sloper section 20 and lower sloper section 30 can also be used for all plus sizes and children's sizes.

In addition, in operation, the upper and lower sleeve sections 94 and 96 are separated to provide adjustable sleeves to accommodate different arm lengths and widths using the sliding connector rods 100 and 102 that are mounted on the upper sleeve section 94, and corresponding sliding guides 104 and 106 that are mounted on the lower sleeve section 96. In operation, the upper sleeve sloper section 20 can be made in all sizes, including such sizes as 0 to 22, and comparable European sizes. Also, in operation, the upper sleeve sloper section 20 and lower sleeve sloper section 30 can also be used for all plus sizes and children's sizes.

Advantages Of The Present Invention

It is an advantage of the present invention to provide ready-made upper and lower sloper sections, which are adjustable in height;

Another advantage of the present invention is to provide ready-made upper and lower sloper sections that have different widths, which are interchangeable to use a wider sloper bottom section with a narrower sloper top section, or vice versa;

Another advantage of the present invention is to provide connectors for upper and lower sloper sections to easily adjust the height of the sloper;

Another advantage of the present invention is to provide connectors for upper and lower sloper sections having measurements on them, so the sloper sections can be adjusted to the desired height;

Another advantage of the present invention is to provide front upper slopers and rear upper slopers, wherein each sloper is adjustable in height using adjustable connectors;

Another advantage of the present invention is to provide a sloper for a sleeve to adjust the length of the sleeves.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A pattern making system to make adjustable height slopers and slopers of different widths and lengths, comprising the steps of:

a) making a plurality of upper sections of a sloper having varying widths and lengths, and wherein each of said upper sections of said sloper has a sliding connector rod or a sliding guide mounted thereon; wherein said sliding connector rod of the upper section is a T-shaped elongated sliding connector rod;

b) making a plurality of lower sections of a sloper having varying widths and lengths, and wherein each of said lower sections of said sloper has a sliding connector rod or a sliding guide mounted thereon; wherein said sliding connector rod of the lower section is a T-shaped elongated sliding connector rod;

c) wherein said sliding connector rods of each of said upper and lower sections of said sloper are oriented generally in overlapping alignment to said sliding guides of said upper and lower sections of said sloper, and wherein said connector rods are slidably and mateably engageable within said sliding guides in order to adjust the height of said engaged upper and lower sections; and d) interchangeably connecting one or more of said plurality of said upper sections of said sloper to one or more of said plurality of lower sections of said sloper in order to make a pattern having an upper and a lower sloper section each having a desired width and length.

2. A pattern making system in accordance with claim 1, wherein said upper and lower sloper sections are connected by two T-shaped elongated sliding connector rods to adjust the height of said connected upper and lower sloper sections.

3. A pattern making system in accordance with claim 1, wherein said upper and lower sloper sections are connected by two T-shaped elongated sliding connector rods to adjust the height of said connected upper and lower sloper sections, wherein said two T-shaped elongated sliding connector rods are mounted on said upper sloper section.

4. A pattern making system in accordance with claim 1, wherein said upper and lower sloper sections are connected by two T-shaped elongated sliding connector rods to adjust the height of said connected upper and lower sloper sections, wherein said two T-shaped elongated sliding connector rods are mounted on said lower sloper section.

5. A pattern making system in accordance with claim 1, wherein said upper and lower sloper sections are connected by two T-shaped elongated sliding connector rods to adjust the height of said connected upper and lower sloper sections, wherein said two T-shaped elongated sliding connector rods are mounted on said upper sloper section, and wherein said upper sloper section has measurement devices connected to said T-shaped elongated sliding connector rods, to accommodate different heights.

6. A pattern making system in accordance with claim 1, wherein said upper and lower sloper sections are connected by two T-shaped elongated sliding connector rods to adjust the height of said connected upper and lower sloper sections, wherein said two T-shaped elongated sliding connector rods are mounted on said lower sloper section, and wherein said lower sloper section has measurement devices connected to said T-shaped elongated sliding connector rods, to accommodate different heights.

7. A pattern making system in accordance with claim 1, wherein said upper and lower sloper sections are connected by one or more rods having pegs mounted thereon to engage one or more corresponding receiving holes on said upper or lower sloper sections to adjust the height of said connected upper and lower sloper sections.

8. A pattern making system in accordance with claim 1, wherein said upper sloper sections are made in different sizes, including such sizes as 0 to 22, and comparable European sizes, and wherein said lower sloper sections can be made in different sizes, including such sizes as 0 to 22, and comparable European sizes, so the user can select an upper section of any size to be matched with a lower section of any size, so that the sloper accommodates all persons in different size ranges and different widths.

* * * * *